US008813709B2

(12) United States Patent
Boegershausen

(10) Patent No.: US 8,813,709 B2
(45) Date of Patent: Aug. 26, 2014

(54) SWITCHABLE PRESSURE SUPPLY DEVICE

(75) Inventor: Mathias Boegershausen, Puschendorf (DE)

(73) Assignee: Schaeffler Technologies GmbH & Co. KG, Herzogenaurach (DE)

( * ) Notice: Subject to any disclaimer, the term of this patent is extended or adjusted under 35 U.S.C. 154(b) by 0 days.

(21) Appl. No.: 13/510,702

(22) PCT Filed: Nov. 17, 2010

(86) PCT No.: PCT/EP2010/067658

§ 371 (c)(1), (2), (4) Date: Aug. 13, 2012

(87) PCT Pub. No.: WO2011/061217

PCT Pub. Date: May 26, 2011

(65) Prior Publication Data

US 2012/0304953 A1 Dec. 6, 2012

(30) Foreign Application Priority Data

Nov. 20, 2009 (DE) ..... 10 2009 054 055

(51) Int. Cl.
*F01L 5/00* (2006.01)

(52) U.S. Cl.
USPC ..... 123/188.4; 123/190.13; 123/90.15

(58) Field of Classification Search
USPC ..... 123/188.4, 188.1, 190.13, 188.9, 90.15, 123/90.29, 90.33
See application file for complete search history.

(56) References Cited

U.S. PATENT DOCUMENTS 5,971,027 A 10/1999 Beachley et al.
6,786,186 B2 * 9/2004 de Ojeda ..... 123/90.55
7,681,542 B2 * 3/2010 Paul et al. ..... 123/90.17
2003/0188705 A1 10/2003 Aimone
2005/0103294 A1 * 5/2005 Heinze et al. ..... 123/90.17
2007/0056540 A1 * 3/2007 Hoppe et al. ..... 123/90.17
2010/0218746 A1 * 9/2010 Rabhi ..... 123/48 B
2011/0247576 A1 * 10/2011 Knecht et al. ..... 123/90.17

FOREIGN PATENT DOCUMENTS

CN 2746125 12/2005
CN 1867755 11/2006
CN 101583782 11/2009
DE 4323133 1/1994

(Continued)

*Primary Examiner* — Noah Kamen
*Assistant Examiner* — Long T Tran
(74) *Attorney, Agent, or Firm* — Volpe and Koenig, P.C.

(57) ABSTRACT

A switchable device for supplying at least one consumer of an internal combustion engine with pressure. The device includes the following: a housing having a housing interior; a displacement element arranged in the housing, which element can be displaced between a first end position and a second end position, the displacement element having a pressure surface which at least partially delimits a fluidically connectible accumulator chamber together with the wall of the housing interior, the accumulator chamber being connectible to a pressure source in a fluid-conducting manner; an energy accumulator which interacts with the displacement element, the displacement element being displaceable against the force of the energy accumulator from the first end position into the second end position under the effect of pressure applied to the accumulator chamber; a locking mechanism by which the displacement element can be locked in the second end position; a switching mechanism which can be actuated by an actuator, has a switch element that can be brought into at least two switching positions and interacts with the locking mechanism in such a manner that the displacement element can be locked and unlocked in a first switching position of the switch element and cannot be locked and not unlocked in a second switching position of the switch element.

15 Claims, 4 Drawing Sheets

(56) References Cited

FOREIGN PATENT DOCUMENTS

| | | |
|---|---|---|
| DE | 19615076 | 6/1997 |
| DE | 19908934 | 9/2000 |
| DE | 19616973 | 11/2003 |
| DE | 19727180 | 12/2003 |
| DE | 10228354 | 1/2004 |
| DE | 10239207 | 3/2004 |
| DE | 202005008264 | 9/2005 |
| DE | 102005013141 | 9/2006 |
| DE | 102007056684 | 5/2009 |
| EP | 1197641 | 4/2002 |
| EP | 1596040 | 11/2005 |
| EP | 1596041 | 11/2005 |
| WO | 2006039966 | 4/2006 |
| WO | 2008140897 | 11/2008 |

* cited by examiner

SWITCHABLE PRESSURE SUPPLY DEVICE

FIELD OF THE INVENTION

The invention lies in the technical field of internal combustion engines and relates to a switchable device for supplying pressure to at least one load of an internal combustion engine.

BACKGROUND

From Patent No. EP 1197641 A2, a pressure accumulator for supporting a hydraulically adjustable camshaft is known in which a flow of pressurized medium into or out of the pressure accumulator is controlled by the use of different solenoid valves.

German Laid Open Patent Application DE 102007056684 A1 of the applicant presents a pressure accumulator with a separate housing.

German Laid Open Patent Application DE 10228354 A1 further describes a pressure accumulator integrated in an inner cavity, wherein installation space in the internal combustion engine can be spared.

SUMMARY

Accordingly, the objective of the present invention relates to refining conventional pressure accumulators for supplying pressure to loads in internal combustion engines in an advantageous manner.

This and other objectives are met according to the proposal of the invention by a switchable device for supplying pressure with the features of the main claim. Advantageous constructions of the invention are specified by the features of the subordinate claims.

According to the invention, a switchable device for supplying pressure (switchable pressure accumulator) to at least one load of an internal combustion engine is shown. The load can involve, in particular, a hydraulic camshaft adjuster for adjusting the phase position between the crankshaft and camshaft. It is also conceivable, however, that the device is used, for example, in an electrohydraulic valve actuation device of an internal combustion engine.

The device for supplying pressure comprises a housing with a cavity. The cavity can involve, for example, an inner cavity of a camshaft, so that the camshaft forms the housing of the switchable device. Alternatively, a housing with a cavity that is different from the hollow camshaft could also be provided, wherein this housing is then inserted into an inner cavity of the camshaft.

The device for supplying pressure further comprises a displacement element that is arranged in the housing cavity and can be displaced between a first end position and a second end position. The displacement element has a pressure surface that at least partially defines a storage space that can be connected or is connected in a fluid-conducting manner to the load together with a wall of the housing cavity. For example, the storage space is connected to the lubricating oil circuit of the internal combustion engine, wherein an oil pump is used as the pressure source and oil of the lubricating oil circuit is used as pressurized medium. The displacement element can be constructed, for example, in the form of a piston with an end-side pressure surface.

The device according to the invention further comprises a force accumulator that interacts with the displacement element so that the displacement element can be displaced by pressurization of the storage space against the force of the force accumulator from the first end position into the second end position. The force accumulator is constructed, for example, as a spring element, in particular, in the form of a compression spring, wherein any other suitable spring type could also be used.

The device according to the invention further comprises a locking mechanism through which the displacement element can be locked detachably in the second end position in which the force accumulator is in tension. In one position of the displacement element different from the second end position, in particular, in the first end position, the displacement element cannot be locked by the locking mechanism.

In addition, the device according to the invention comprises a switch mechanism that is actuated by an actuator and has a switch element that can be brought into at least two switch positions, wherein the switch element interacts with the locking mechanism so that the displacement element can be locked in a first switch position of the switch element both from an unlocked state and also can be unlocked from a locked state and in a second switch position of the switch element, can be neither locked in the unlocked state nor unlocked in the locked state.

For relatively low installation space requirements, the device according to the invention allows a more reliable and more secure supply of pressure to the loads of an internal combustion engine that is provided independent of the pressure in the lubricating circuit of the internal combustion engine.

In one advantageous construction of the device according to the invention, it comprises a ball carrier element that is connected rigidly to the housing and has a carrier cavity in which the switch element is held at least partially. Here, the ball carrier element has a plurality of openings in each of which a ball is held so that it can move in the radial direction. The balls contact an outer lateral surface formed by the switch element. In this construction of the device, the device further comprises a locking element that is connected rigidly to the displacement element and is provided with a locking section that can be led into engagement with the balls in the second end position of the displacement element, for example, in that it engages behind these balls, in order to lock the displacement element on the housing. On the other side, the locking element is not led into engagement with the balls in the first end position of the displacement body, so that the displacement element is not locked. In this construction of the device, a restoring element is also provided that is arranged so that the switch element can be displaced by the actuator relative to the ball carrier element against the force of the restoring element from the first switch position into the second switch position. The first restoring element is constructed, for example, as a spring element, in particular, in the form of a compression spring, wherein any other suitable spring type could also be used. In this construction of the device, the outer lateral surface of the switch element is provided with at least one recess that is allocated to the balls and is constructed and arranged so that the balls can be held at least partially in the recess in the second switch position of the switch element, so that the locking section is led out of engagement with the balls and the locking of the displacement element is released. On the other side, the balls are not held by the recess of the support surface in the first switch position of the switch element, so that the locking of the displacement element is maintained.

These measures allow a technically especially simple realization of the device according to the invention that is distinguished by an especially good response behavior.

In the above construction of the invention, it can also be advantageous if a securing element connected rigidly to the ball carrier element is arranged that forms a stop for a radially outward directed movement of the balls, such that the balls are held captively in the openings. In one technically simple realization of the securing element, it has a pot-shaped construction and is placed onto the ball carrier element from one side. Here, the securing element and the ball carrier element can be connected rigidly to each other, for example, by pressing. Thus the sliding element forms a captive securing device for the balls when these are not in engagement with the locking section of the locking element.

In another advantageous construction of the device according to the invention for supplying pressure, this is provided with a sealing element that seals the cavity to the outside and on which the force accumulator of the displacement element is supported. The sealing element can be used here especially for securing the position of the force accumulator. In this case it can also be advantageous if the ball carrier element is connected rigidly to the sealing element. In addition, it can be advantageous if the sealing element is provided with a passage opening in which a switch body that interacts with the switch element and can be actuated by the actuator is held in a displaceable manner. Through these measures, the device according to the invention can be realized in a technically especially simple way.

In another advantageous construction of the device according to the invention, the storage space can be connected or is connected to the pressure source and optionally to the load in a fluid-conducting manner with at least one leakage prevention device positioned in-between. The leakage prevention device is constructed so that it allows the through flow of the pressurized pressure medium while blocking the through flow of non-pressurized pressure medium that is merely at hydrostatic pressure. Thus, the leakage prevention device can prevent leakage from the storage space if pressure is not supplier by the pressure source, for example, in the event of insufficient output of the oil pump. The leakage prevention device can be used as a limit for the storage space and can form, in particular, a stop for the displacement element in the first end position. The construction of such a leakage prevention device is known to someone skilled in the art and is described in the patent literature, for example, in DE 19615076.

In another advantageous construction of the device according to the invention, the pressure source can be connected or is connected to the storage space in a fluid-conducting manner via a non-return valve that forms a block in the direction toward the pressure source.

The invention further extends to an internal combustion engine that is equipped with at least one device that can be switched as described above for supplying pressure to at least one load.

BRIEF DESCRIPTION OF THE DRAWINGS

The invention will now be explained in more detail with reference to an embodiment, wherein reference is made to the accompanying drawings. Elements that are identical or have identical actions are designated in the drawings with the same reference symbols. Shown are.

DETAILED DESCRIPTION OF THE PREFERRED EMBODIMENTS

Figure 1:
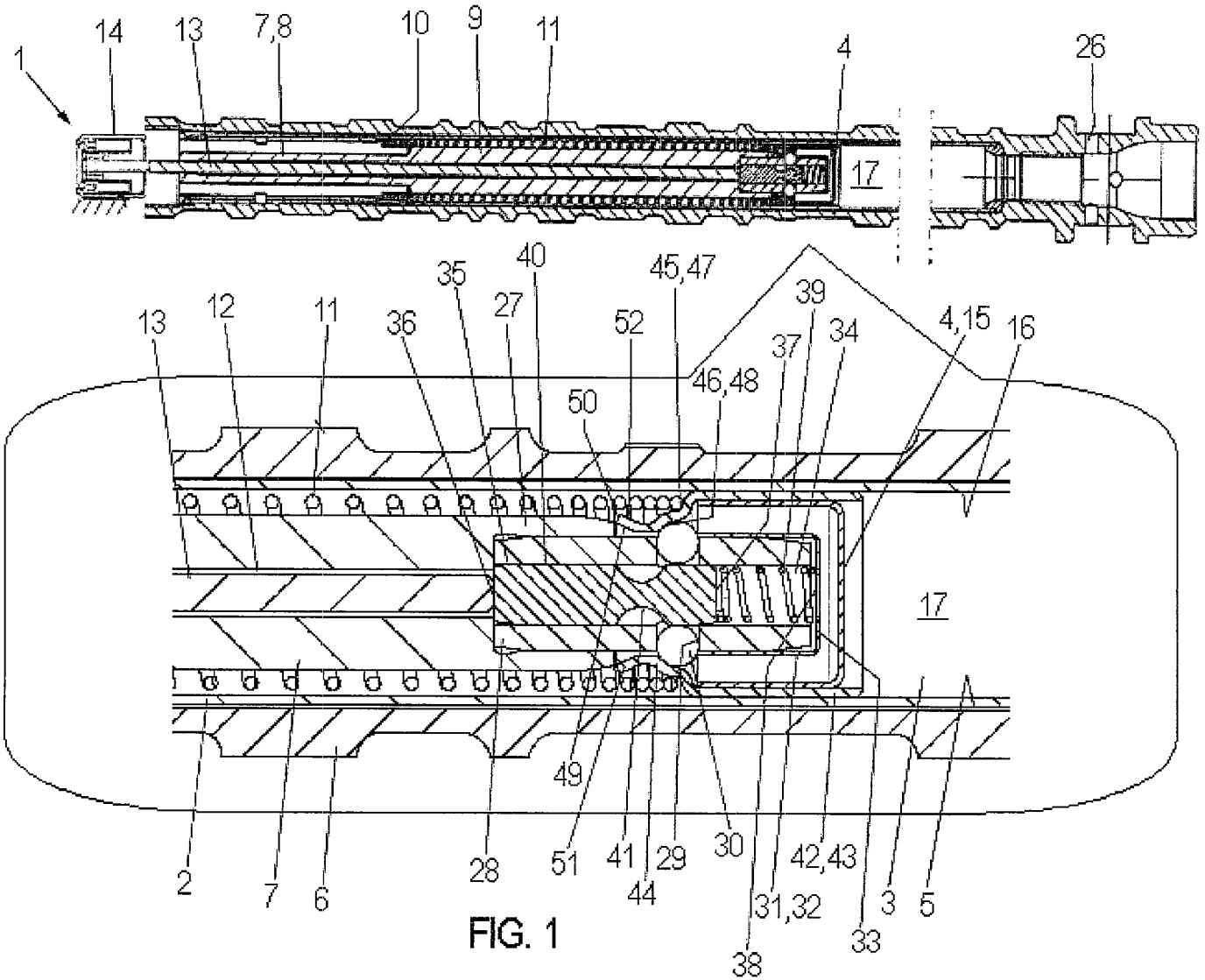
FIG. 1 is a schematic axial section view with an enlarged section showing an embodiment of the device according to the invention for supplying pressure.
Figure 2:
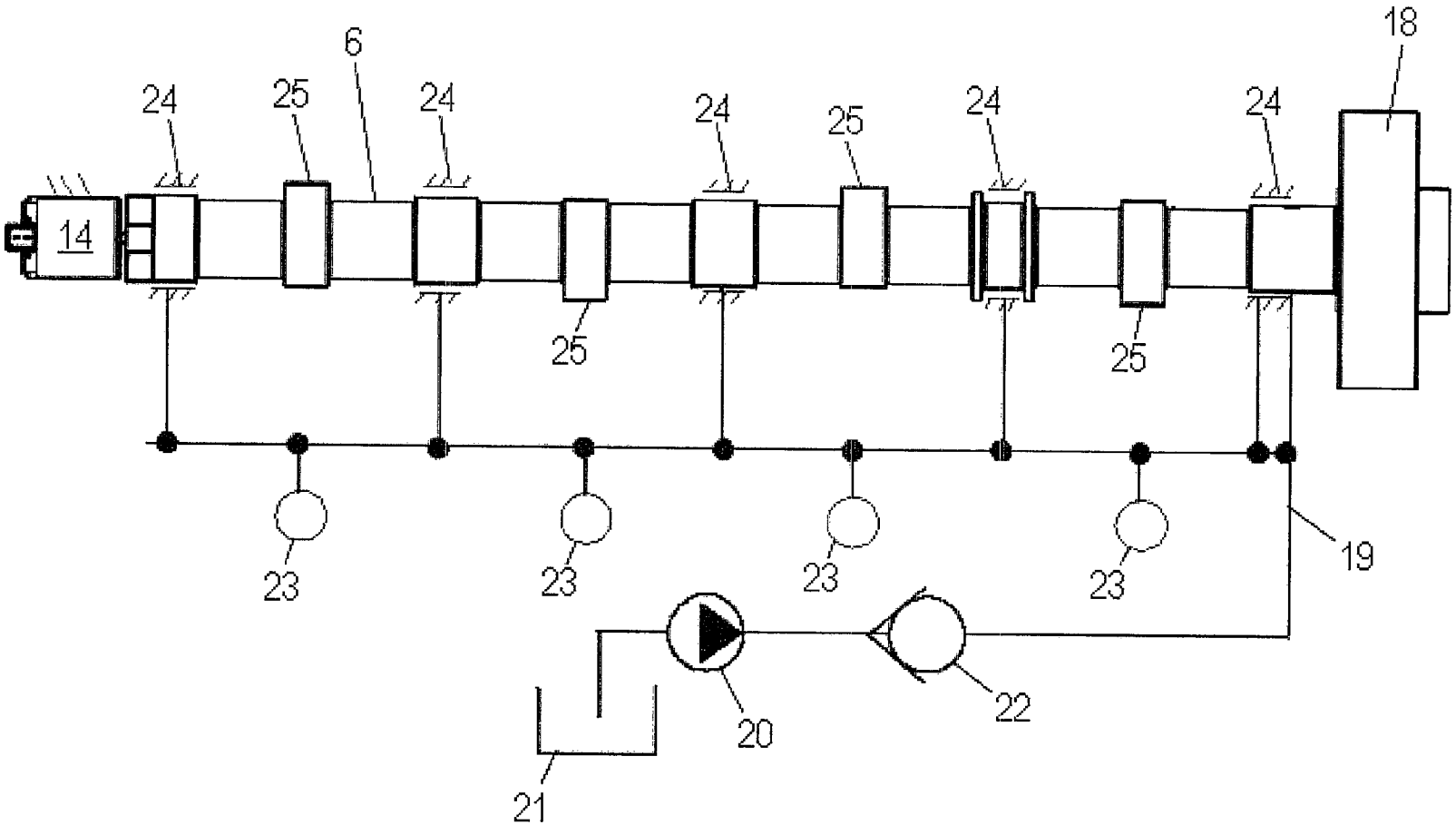
FIG. 2 is a schematic overview diagram, with reference to which the connection of the device for supplying pressure from FIG. 1 to the lubricating oil circuit of an internal combustion engine is illustrated.

FIG. 1 and FIG. 2 will be considered first, wherein an embodiment of the device according to the invention for supplying pressure to loads of an internal combustion engine, as well as the connection of the device to the lubricating oil circuit of an internal combustion engine, are shown. The device designated overall with the reference number 1 can be inserted in a camshaft cavity 5 of a hollow camshaft 6. The camshaft 6 that is built-up as an example here and is provided with a plurality of cams 25 on its outer peripheral surface can be rotated about a central rotational axis 7. The same would also be conceivable, however, if the camshaft 2 was produced in the foundry process.

The device 1 for supplying pressure to loads of an internal combustion engine comprises a hollow cylindrical housing 2 ("cartridge") that is constructed with an interference fit relative to the camshaft cavity 5, so that the device 1 can be easily integrated into the camshaft 6 by inserting the housing 2 into the camshaft cavity 5 and connecting it rigidly to the camshaft 6.

The housing 2 forms a housing cavity 3 in which a displacement element constructed in the form of a piston 4 is held so that it can be displaced in the axial direction. A sealing body 7 is further pressed in the housing cavity 3, wherein this sealing body is constructed in the shape of a stepped cylinder and extends from one end of the housing 2 into the housing cavity 3. It can be divided into a terminal first section 8 with larger diameter and an adjacent second section 9 with smaller diameter, wherein a ring stage 10 is produced. A force accumulator spring (helical compression spring) 11 used as a force accumulator is supported with one of its ends on the ring stage 10. With its other end, this force accumulator contacts the piston 4.

The sealing body 7 connected rigidly to the housing 2 is provided with a central axial bore 12 in which a switch rod 13 is held so that it can be displaced in the axial direction. The switch rod 13 can be actuated by an electromagnetic actuator 14, wherein a tappet that is not shown in more detail engages an end-side contact surface of the switch rod 13 for this purpose. The switch rod 12 is part of a switch mechanism for locking and releasing a locking mechanism for the piston 4 that will be explained in more detail farther below. The piston 4 has an end-side pressure surface 15 that at least partially defines a storage space 17 for pressurized oil 28 together with a housing cavity wall 16 of the housing cavity 3.

Opposite the actuator 14, a hydraulic camshaft adjuster 18 is attached, for example, by means of a (not shown) central screw to the end side of the camshaft 6. As usual, the hydraulic camshaft adjuster 18 comprises a drive part in drive connection with the crankshaft via a drive wheel and a camshaft-fixed driven part, as well as a hydraulic actuating drive that is located between the drive part and the driven part and transfers the torque from the drive part to the driven part and allows an adjustment and fixing of the rotational position between these parts. The hydraulic actuating drive is provided with at least one pressure chamber pair that act against each other and can be selectively pressurized with pressurized oil, in order to generate a change in the rotational position between the drive part and driven part by generating a pressure drop across the two pressure chambers. Hydraulic camshaft adjusters as such are well known to someone skilled in the art and described in detail, for example, in publications DE 202005008264 U1, EP 1596040 A2, DE 102005013141 A1, DE 19908934 A1, and WO 2006/039966 of the applicant, so that more exact details do not need to be discussed here.

As can be taken from the overview diagram of FIG. 2, the hydraulic camshaft adjuster 18 and the storage space 17 are connected in a fluid-conducting manner to a pressure source or pressurized medium source constructed in the form of an oil pump 20 via a pressure line 19. Here, the pressure line 19 is connected to radial openings 26 of the camshaft 6 opening into the camshaft cavity 5. The oil pump 22 can thus feed pressurized oil from an oil tank 21 to the camshaft adjuster 18 and storage space 17. A non-return valve 22 that is arranged in the pressure line 19 and forms a block in the direction toward the oil pump 20 prevents a return flow of pressurized oil in the case of reduced or insufficient output from the oil pump 20.

In the central screw for fastening the camshaft adjuster 18 to the camshaft 6, a control valve not shown in more detail is arranged for controlling the oil flows. This control valve can connect the pressure chambers of the camshaft adjuster 18 in a fluid-conducting manner selectively with the oil pump 20 or with the oil tank 21. Such control valves are well known as such to someone skilled in the art and described in detail, for example, in the German Patent DE 19727180 C2, the German Patent DE 19616973 C2, the European Patent Application EP 1 596 041 A2, and the German Laid Open Patent Application DE 102 39 207 A1 of the applicant, so that more exact details do not have to be discussed here.

In the device 1, the storage space 17 communicates with the hydraulic camshaft adjuster 18 or its control valve. In addition, additional loads are connected to the lubricating oil circuit, such as support elements 23 and bearing points 24 of the camshaft 6 that must be supplied with pressurized oil. Although this is not shown in the figures, a leakage prevention device for limiting the storage space 17 could be provided that could be used, in particular, as a stop for the piston 4.

In the device 1, the piston 4 can be pushed in the axial direction against the spring force of the force accumulator spring 11 by pressurization of the storage space 17, in that pressurized oil is fed by the oil pump 20 via the pressure line 19 into the storage space 17. Here, the piston 4 is pushed from a first end position into a second end position in which the force accumulator spring 11 is tensioned or is more strongly tensioned in the event of a biasing tension. The storage space 17 is sealed oil-tight from the outside by means of ring seals that are not shown in more detail.

In the second end position, the piston 4 can be locked by a locking mechanism. The locking mechanism comprises a sleeve-shaped ball carrier 31 that is pressed into a sleeve-shaped end section 27 of the sealing body 7 and has a plurality of radial bores 29 arranged distributed in the peripheral direction. A ball 30 is held in each of these bores. Here, the bores 29 each have a larger diameter than the balls 30, so that these are freely moveable in the radial direction in the bores 29. The ball carrier 28 is connected rigidly to the sealing body 7.

A pot-shaped securing body 31 having a base wall 33 and a hollow cylindrical sleeve part 32 is pressed onto the free end section of the ball carrier 28 opposite the sealing body 7. Here, the sleeve part 32 of the securing body 31 is dimensioned so that it partially covers the radial bores 29 with a certain overlap, so that only a certain radially directed movement of the balls 33 is allowed. An additional, radially outward directed movement of the balls 30 is blocked by the sleeve part 32, so that the balls 30 all remain held in the bores 29.

A switch pin 35 coupled with the switch rod 13 that can be displaced in the axial direction is held in a carrier cavity 34 of the ball carrier 28 so that it can be displaced in the axial direction. The switch pin 35 has a first end surface 36 that is coupled with an end-side end of the switch rod 35. A restoring spring 39 is further held in the carrier cavity 34, wherein this restoring spring is supported with its one end on a second end surface 37 of the switch pin 35 opposite the first end surface 37 and is supported with its other end on an inner surface 38 of the base wall 33 of the securing body 31. The restoring spring 39 is here constructed, for example, as a helical compression spring, but could also be any other suitable type of spring. The switch pin 35 can thus be displaced in the axial direction by moving the switch rod 13 by the tappet of the actuator 14 against the spring force of the restoring spring 39. Here, the tappet acts on the end-side contact surface of the switch rod 13, wherein the tappet is connected rigidly to a magnetic armature of an electromagnet of the actuator 14 and can be displaced in the axial direction by energizing the magnetic armature. If the magnetic armature is not energized, the switch pin 35 is restored by the spring force of the restoring spring 39.

An outer lateral surface 40 of the switch pin 35 is provided with a peripheral ring groove 41 that is allocated to the balls 30 and is constructed with an interference fit relative to the balls 30. The switch pin 35 can be moved back and forth by the opposite forces of the actuator 14 and restoring spring 39 between two end positions. In a first end position when the actuator 14 is not activated, the balls 30 are outside of the ring groove 41. In a second end position when the actuator 14 is activated, the balls 30 can be inserted into the ring groove 41. The balls 30 always contact the outer lateral surface 40 of the switch pin 35, so that they are held in the bores 29 in connection with the securing body 31 in a captive manner.

A locking body 42 is pressed onto the piston 4. The locking body 42 is provided with a hollow cylindrical sleeve section 43 that is placed on the pot-shaped piston 4 and on which a locking section 44 connects for this purpose. The sleeve section 43 is used for the axial guidance of the piston 4 within the housing cavity 3. The locking section 44 tapers in steps in the direction toward the actuator 14. Here, a first step 45 tapering toward the actuator 14 forms a ring-shaped support surface 47 for the force accumulator spring 11. An adjacent, second step 46 tapering toward the actuator 14 forms a ring-shaped seating surface 48 for the balls 30. A collar 52 that is formed on the second step 46 and extends radially relative to the second step 46 forms a contact surface 49 for the balls 30.

A locking and unlocking process of the piston 4 of the device 1 will now be described, wherein reference will be made to FIGS. 3A-3E.

Figure 3A:
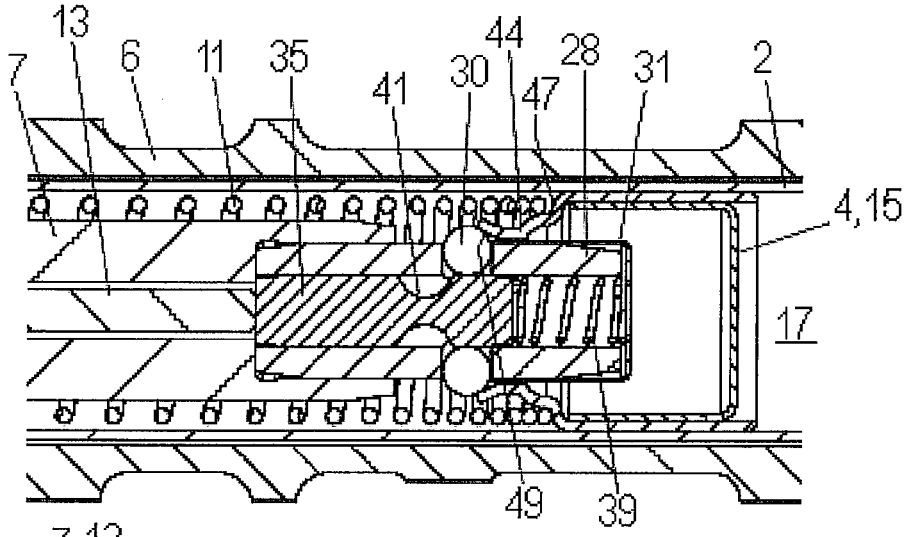
FIGS. 3A-3E are enlarged axial section views for illustrating the locking of the device for supplying pressure from FIG. 1.

If the storage space 17 is charged with pressurized oil by the oil pump 20, the piston 4 is displaced by means of its pressure surface 15 against the spring force of the force accumulator spring 11 until the contact surface 49 of the locking body 42 is led into contact with the balls 30. If the actuator 14 is not activated, the switch pin 35 is restored by the spring force of the restoring spring 39. In this position of the switch pin 35, the balls 30 are outside of the ring groove 41. Here, the locking section 44 of the locking body 42 is sufficiently resistant to deformation, so that it cannot slide over the balls 30. This situation is shown in FIG. 3A.

Figure 3B:
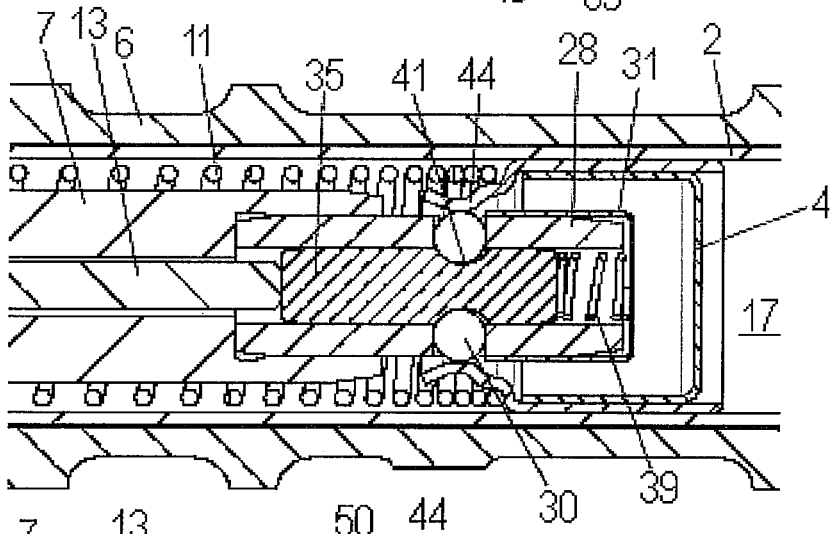

If the actuator 14 is activated by the electromagnet being energized, the switch rod 13 is moved against the force of the restoring spring 39 by the tappet engaging the end-side contact surface. Here, the switch pin 35 is brought by the switch rod 13 into a position in which the ring groove 41 is on the radial inside of the bores 29 or balls 30, so that the balls 30 can be inserted into the ring groove 41. Thus, the balls 30 are pressed into the ring groove 41, charged by the locking section 44. The depth of the ring groove 41 is dimensioned so that the piston 4 or the locking section 44 connected rigidly to the piston 4 can be displaced even farther against the spring force of the force accumulator spring 11. For example, the balls 30 are held completely within the bores 29 and seal at least approximately flush with an outer lateral surface of the ball carrier 28. This situation is shown in FIG. 3B.

If the piston 4 is displaced father against the spring force of the force accumulator spring 11, charged by the pressurized oil in the storage space 17, an end-side contact surface 50 of the locking body 42 is finally led into contact with an end-side contact surface 51 of the sealing body 7. This defines an end position (designated "second end position" in the introduction of the description) of the piston 4 in which the storage space 17 is filled with a maximum amount of pressurized oil. If the actuator 14 is no longer activated, i.e., if the electromagnet is no longer energized, the switch pin 35 is displaced in the axial direction relative to the ball carrier 28 by the spring force of the restoring spring 39, wherein the balls 30 are pressed out from the ring groove 41 against the seating surface 48 of the locking section 44. In this position, the locking section 43 engages behind the balls 30, so that the piston 4 is fixed in the axial direction. This situation is shown in FIG. 3C.

The piston 4 can thus be locked in its second end position only by activating the tappet for displacing the switch pin 35 against the spring force of the restoring spring 39 from the first switch position into the second switch position. The piston 4 cannot be locked without displacing the switch pin 35 into the second switch position.

Figure 3C:
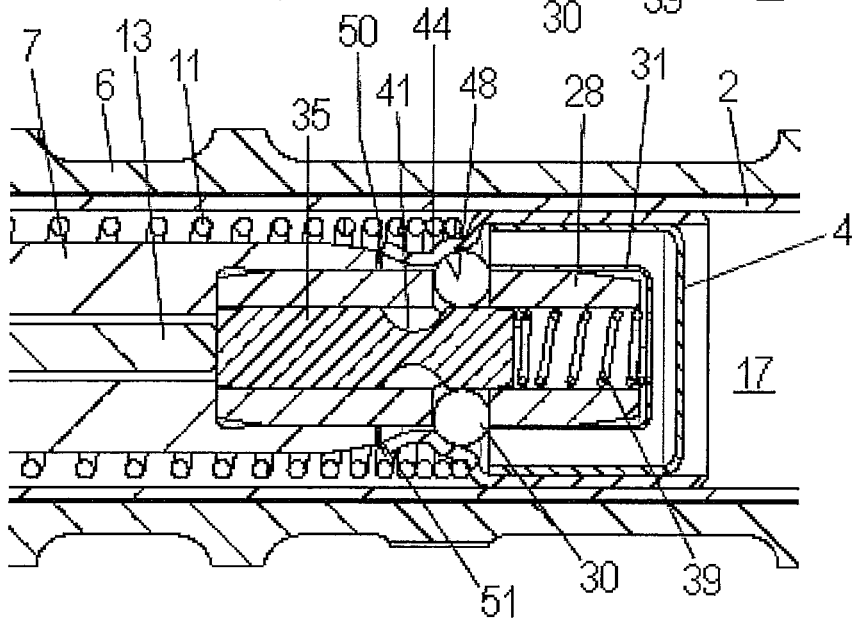
Figure 3D:
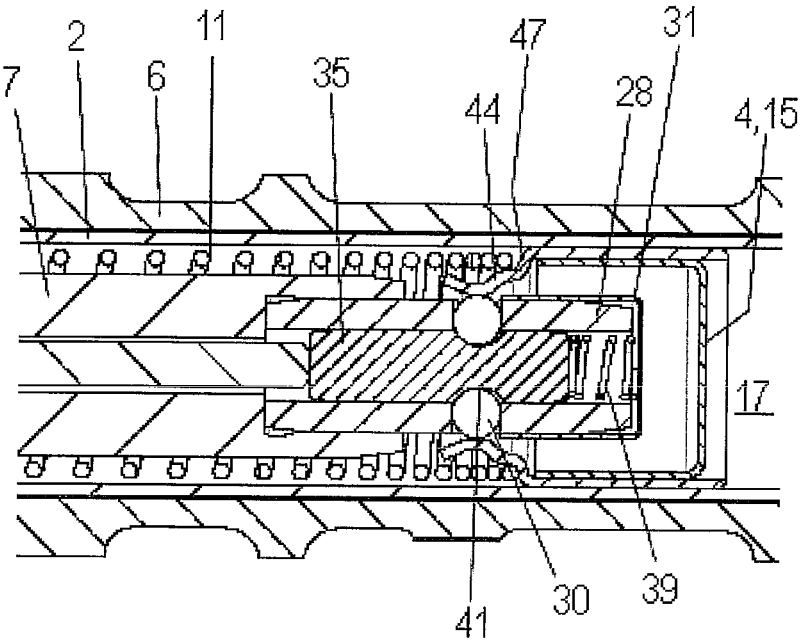
Figure 3E:
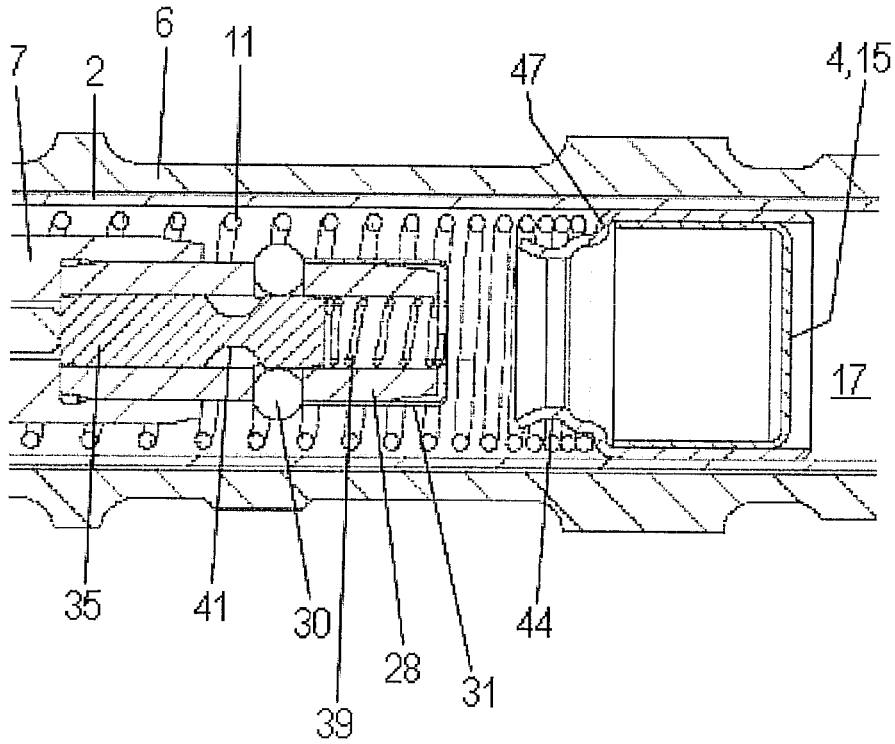

Starting from a locked piston 4 as shown in FIG. 3C, if the actuator 14 is now activated by the electromagnet being repeatedly energized, the switch rod 13 is moved against the force of the restoring spring 39 by the tappet contacting the end-side contact surface. Here, the switch pin 35 is brought into the second switch position by the switch rod 13 in which the ring groove 41 is radially inside of the bores 29 or balls 30, so that the balls 30 can be inserted into the ring groove 41. The balls 30 are then pressed into the ring groove 41, charged by the spring force of the force accumulator spring 11, by means of the locking section 44. This has the result that the locking section 44 no longer engages behind the balls 30 and the locking of the piston 4 is released. This situation is shown in FIG. 3D.

This has the result that the piston 4 is displaced by the spring force of the force accumulator spring 11, wherein pressurized oil is discharged from the storage space 17 to the hydraulic camshaft adjuster 18. The piston 4 is displaced, charged by the spring force, until it comes into contact with a stop 53 formed by the camshaft 6, which defines an end position of the piston 4 (designated as "first end position" in the introduction of the description). Movement of the piston 4 between the two end positions corresponds to a maximum piston stroke of the piston 4, which specifies the maximum displaced volume. Alternatively, a leakage prevention device could be used as an end stop for the piston 4.

The piston 4 can thus be unlocked first by activating the tappet for displacing the switch pin 35 against the spring force of the restoring spring 39 from the first switch position into the second switch position. The piston 4 cannot be unlocked without displacing the switch pin 35 into the second switch position.

In the device according to the invention, a piston integrated into a cavity of the camshaft by means of a separate housing can thus be biased by the pressure of the oil pump when the internal combustion engine is running against the force accumulator spring up to a specified stroke. In this position, the piston is engaged through short activation of the radially decoupled actuator that is mounted outside of the camshaft in a holding mechanism (ball locking). When the internal combustion engine is turned off, the oil pressure in the oil galleries falls to ambient pressure, just like the pressure in the pressure accumulator. Energy is still stored in the force accumulator spring. Through an optional leakage prevention device, the "pressure-free" lubricating oil cannot be returned from the storage space into the oil galleries or via the camshaft bearing points into the cylinder head. A plate-labyrinth leakage prevention device consisting of three plates each with a bore in the axial direction on the outer diameter is used, for example, as the leakage prevention device. The plates are rotated by 120° relative to each other. The pressure accumulator has no pressure loss due to leakage. Complicated high-pressure seals are eliminated. In this way, the system friction is reduced and more usable energy is stored in the force accumulator spring. On the other hand, through short activation of the actuator, the locking mechanism of the piston can be released. By means of the biased force accumulator spring, the oil is pressed out from the storage space back into the oil circuit of the cylinder head and the camshaft adjuster, assuming that the supply oil pressure in the oil galleries is less than the pressure that can be achieved with the pressure accumulator (spring element force multiplied with piston pressure surface area). To prevent a return flow of the oil in the direction of the oil pump during discharge, a non-return valve that forms a block in the direction of the oil pump is provided between the oil pump and the loads that are to be loaded with oil pressure from the pressure accumulator.

In the device according to the invention, the piston is guided in the axial direction in the housing and is supported on the sealing body by means of a spring element (e.g., tensile or compression spring) that is pressed into the housing. The ball carrier is pressed into the sealing body. This has, for example, eight radial bores in each of which a ball is guided. The switch rod is coupled with the switch pin and supported so that it can be displaced in the axial direction in the sealing body. The actuator is screwed, for example, in the cylinder head and presses on the switch rod against the restoring spring of the switch pin in the energized state. The connection of the switch rod/camshaft is realized by means of a radial decoupling. The securing body is used for captive securing of the balls. The arrangement in the cavity of the camshaft produces an advantage in terms of installation space compared with pressure accumulators arranged external to the camshaft.

The device according to the invention allows a reliable supply of pressure to loads of an internal combustion engine, wherein pressurized oil is made available through the pressure accumulator integrated in the camshaft independent of the engine oil supply (lubricating oil circuit) of the internal combustion engine. Thus, loads can be supplied with pressurized oil even if the engine-side oil supply is not sufficient, for example, when the engine is started and in the event of very hot pressurized oil in connection with a low output of the oil pump (hot idling). In particular, immediately after the start of the internal combustion engine, an adjustment of the camshaft adjuster into the base position (retarded, middle, advanced position) can be realized, which is especially suitable in connection with start/stop systems. In addition, the adjustment rate of the camshaft adjuster can be improved especially for hot idling of the internal combustion engine. The device according to the invention can be realized by relatively few components, which can save costs in terms of assembly and materials in industrial series production. One special advantage of the device is given from the fact that the piston can be locked or unlocked by short activation of the actuator (current pulses). Permanent activation of the actuator in the locked or unlocked state of the piston is not necessary. This allows an especially energy-saving activation of the device for supplying pressure.

LIST OF REFERENCE SYMBOLS

1 Device
2 Housing
3 Housing cavity
4 Piston
5 Camshaft cavity
6 Camshaft
7 Sealing body
8 First section
9 Second section
10 Ring step
11 Force accumulator spring
12 Axial bore
13 Switch rod
14 Actuator
15 Pressure surface
16 Housing cavity wall
17 Storage space
18 Camshaft adjuster
19 Pressure line
20 Oil pump
21 Oil tank
22 Non-return valve
23 Support element
24 Bearing point
25 Cam
26 Radial opening
27 End section
28 Ball carrier
29 Bore
30 Ball
31 Securing body
32 Sleeve part
33 Base wall
34 Carrier cavity
35 Switch pin
36 First end surface
37 Second end surface
38 Inner surface
39 Restoring spring
40 Outer lateral surface
41 Ring groove
42 Locking body
43 Sleeve section
44 Locking section
45 First step
46 Second step
47 Support surface
48 Seating surface
49 Contact surface
50 Contact surface of the locking body
51 Contact surface of the sealing body
52 Collar
53 Stop

The invention claimed is:

1. A switchable device for accumulating, storing, and supplying hydraulic fluid under pressure to at least one load of an internal combustion engine, comprising:

a housing with a housing cavity, a displacement element that is arranged in the housing cavity and is displaceable between a first end position and a second end position, wherein the displacement element is provided with a pressure surface that at least partially defines, together with a housing cavity wall, a storage space that is connectable in a fluid-conducting manner to the load, wherein the storage space is connectable in a fluid-conducting manner to a pressure source, a force accumulator interacting with the displacement element, the displacement element is displaceable through pressurization of the storage space against a force of the force accumulator from the first end position into the second end position, a locking mechanism having a locking element that is connected to the displacement element, the locking element includes a locking section that engages an element connected to the housing to lock the displacement element in the second end position, a switch mechanism that is activatable by an actuator including a switch element that can be brought into at least first and second switch positions and interacts with the locking mechanism so that the displacement element can be locked or unlocked in the first switch position of the switch element and cannot be locked or cannot be unlocked in the second switch position of the switch element.

2. Device for supplying pressure according to claim 1, wherein the element connected to the housing comprises a ball carrier element that is connected rigidly to the housing and has a carrier cavity in which the switch element is held at least partially, the ball carrier element has a plurality of openings with corresponding balls being held in each of the openings so that the balls can move in a radial direction, the balls contact an outer lateral surface formed by the switch element, the locking section of the locking element that is connected to the displacement element is led into engagement with the balls for locking the displacement element in the second end position, the switch element is displaceable relative to the ball carrier element against a force of a restoring element by the actuator from the first switch position into the second switch position, and an outer lateral surface of the switch element is provided with at least one recess such that the balls can be held in the second switch position at least partially by the at least one recess, so that the locking section is led out of engagement with the balls.

3. Device for supplying pressure according to claim 2, further comprising a sealing element that is connected rigidly to the housing and on which the force accumulator of the displacement element is supported.

4. Device for supplying pressure according to claim 3, wherein the ball carrier is connected rigidly to the sealing element.

5. Device for supplying pressure according to claim 4, wherein the sealing element is provided with a passage opening in which a switch body that is activatable by the actuator and interacts with the switch element is held so that it can be displaced.

6. Device for supplying pressure according to claim 5, further comprising a securing element that is connected rigidly to the ball carrier element and forms a stop for a radially outward directed movement of the balls, such that the balls are held in the openings in a captive manner.

7. Device for supplying pressure according to claim 6, wherein the securing element has a pot-shaped construction and is placed from one side onto the ball carrier element.

8. Device for supplying pressure according to claim 1, wherein the force accumulator is constructed as a spring element.

9. Device for supplying pressure according to claim 1, wherein the housing is inserted into a cavity of a camshaft.

10. Device for supplying pressure according to claim 1, wherein the housing is formed by a camshaft and the housing cavity is formed by a cavity of the camshaft.

11. Device for supplying pressure according to claim 1, wherein the storage space is connectable in a fluid-conducting manner to the pressure source via a leakage prevention device, and the leakage prevention device is transmissible for pressurized medium with pressurization and forms a block for pressurized medium without pressurization.

12. Device for supplying pressure according to claim 11, wherein the leakage prevention device is used as a limit for the storage space.

13. Device for supplying pressure according to claim 1, further comprising a pressure source that is connectable in a fluid-conducting manner to the storage space via at least one non-return valve that forms a block in a direction of the pressure source.

14. Device for supplying pressure according to claim 1, wherein oil from a lubricating oil circuit is used as the pressurized medium.

15. Internal combustion engine with at least one switchable device for supplying pressure to a load according to claim 1.

* * * * *